10/15/85 CF 4,547,303

United States Patent [19]

Deck et al.

[11] Patent Number: 4,547,303

[45] Date of Patent: Oct. 15, 1985

[54] WATER-BASED FUNCTIONAL FLUIDS THICKENED BY THE INTERACTION OF AN ASSOCIATIVE POLYETHER THICKENER AND CERTAIN QUATERNARY AMMONIUM SALTS

[75] Inventors: Charles F. Deck, Trenton; James E. Carson, Lincoln Park, both of Mich.

[73] Assignee: BASF Wyandotte Corporation, Wyandotte, Mich.

[21] Appl. No.: 667,149

[22] Filed: Nov. 1, 1984

[51] Int. Cl.[4] ..... C10M 1/32

[52] U.S. Cl. ..... 252/73; 252/34; 252/47; 252/50; 252/77

[58] Field of Search ..... 252/73, 75, 77, 78.1, 252/34, 47, 50

[56] References Cited

U.S. PATENT DOCUMENTS

| | | | |
|---|---|---|---|
| 3,711,409 | 1/1973 | Ayrer et al. | 252/73 |
| 3,790,487 | 2/1974 | Burrous | 252/77 |
| 4,312,775 | 1/1982 | Panek et al. | 252/78.5 |
| 4,470,918 | 9/1984 | Mosier | 252/77 |

*Primary Examiner*—Paul Lieberman
*Assistant Examiner*—Hoa Van Le
*Attorney, Agent, or Firm*—David L. Hedden; Joseph D. Michaels

[57] ABSTRACT

The invention relates to a water-based functional fluid thickened by an associative polyether thickener whose thickening ability is enhanced by the addition of certain quaternary ammonium salts.

6 Claims, No Drawings

WATER-BASED FUNCTIONAL FLUIDS THICKENED BY THE INTERACTION OF AN ASSOCIATIVE POLYETHER THICKENER AND CERTAIN QUATERNARY AMMONIUM SALTS

BACKGROUND OF THE INVENTION

1. Field of the Invention

This invention relates to water-based functional fluids thickened by an associative polyether thickener whose thickening power is enhanced by the addition of certain quaternary ammonium salts.

2. Description of the Prior Art

U.S. Pat. No. 4,411,819 discloses the advantages of using associative polyether thickeners to thicken water-based functional fluids. Although these thickeners have excellent thickening ability, they are expensive and new methods for decreasing the amount of such thickeners have been explored. For instance, U.S. Pat. No. 4,312,775 discloses that reduced amounts of associative polyether thickener can be used in conjunction with ethoxylated phosphate ester.

SUMMARY OF THE INVENTION

The subject invention relates to a functional fluid comprising (a) from about 60.0 percent by weight to about 99.0 percent by weight of water, a freezing point additive or both;

(b) from about 1.0 percent by weight to about 25.0 percent by weight of a thickener component comprising (i) an associative polyether thickener, and (ii) a quaternary ammonium salt having the following chemical structure:

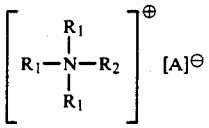

wherein $R_1$ is individually an alkyl radical having 1 to 4 carbon atoms, $R_2$ is an alkyl radical having 10 to 20 carbon atoms, and A is an anion which will form a salt with the ammonium cation;

such that the weight ratio of (i) to (ii) is from about 1:10 to about 10:1.

The addition of the quaternary ammonium salt enhances the thickening ability of the associative polyether thickener so that it is not only possible to use less associative polyether thickener without reducing the viscosity of the fluid, but it is possible to increase the viscosity of the fluid.

The functional fluids can be used in hydraulic systems or as metalworking compositions to cool and lubricate surfaces which are in frictional contact during operations such as the turning, cutting, peeling, or the grinding of metals. The fluids are prepared in general by mixing the thickening component with water in the required proportions. Some or all of the water may be replaced by a freezing point lowering additive such as ethylene glycol, propylene glycol, butylene glycol, diethylene glycol, dipropylene glycol, triethylene glycol, tetraethylene glycol, and the like, or mixtures thereof.

DESCRIPTION OF THE PREFERRED EMBODIMENTS

The associative polyether thickeners which are used in the thickening component are relatively new in the art and are disclosed in U.S. Pat. Nos. 4,288,639; 4,312,775; and 4,411,819 which are incorporated herein by reference. These thickeners are prepared by first reacting ethylene oxide or ethylene oxide and generally at least one lower alkylene oxide with at least one active hydrogen-containing compound and subsequently reacting therewith at least one long chain aliphatic alpha-olefin epoxide or glycidyl ether. The long chain alpha-olefin epoxide or glycidyl ether has a carbon chain length of about 12 to about 18 aliphatic carbon atoms. The proportion of alpha-olefin epoxide or glycidyl ether present in the polyether thickener is generally 1 to about 20 percent by weight, based upon the total weight of the thickener.

The associative polyether thickeners may be readily prepared by modifying a conventional non-associative polyether aqueous thickener by reacting it with an alpha-olefin epoxide or glycidyl ether having about 12 to about 18 carbon atoms or mixtures thereof. The conventional non-associative polyether polyol thickener can be an ethylene oxide-derived homopolymer or a heteric or block copolymer of ethylene oxide and at least one lower alkylene oxide preferably having 3 to 4 carbon atoms. The ethylene oxide is used generally as a reactant in the proportion of at least 10 percent by weight based upon the total weight of the polyether thickener. Preferably, about 60 to 99 percent by weight ethylene oxide is utilized with about 40 to 1 percent by weight of a lower alkylene oxide preferably having 3 to 4 carbon atoms.

The preferred nonassociative polyether thickeners used to prepare the associative thickeners are prepared by methods well known in the art. Generally this involves reacting an active hydrogen-containing compound in the presence of an acidic or basic oxyalkylation catalyst and an inert organic solvent at elevated temperatures in the range of about 50° C. to 150° C. under an inert gas pressure, generally from about 20 to about 100 pounds per square inch gauge. Generally, both monohydric and polyhydric alcohol initiators are useful. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing about 12 to about 18 carbon atoms in the aliphatic or alkyl group. In addition, aliphatic mercaptans having about 12 to about 18 carbon atoms are useful initiators.

In this manner, heteric, block, and homopolymer nonassociative polyether thickeners, preferably having average molecular weights of about 1,000 to about 60,000, preferably 5,000 to 40,000, are prepared which can be used to prepare associative polyether thickeners by reacting them with long chain, aliphatic alpha-olefin epoxides or glycidyl ethers.

The quaternary ammonium salts which are used in the thickening component of the subject concentrates and fluids are well known in the art and are commerically available. They have the following chemical structure:

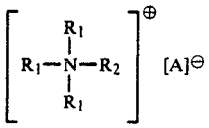

wherein $R_1$ is individually an alkyl radical having 1 to 4 carbon atoms, $R_2$ is an alkyl radical having 10 to 20 carbon atoms, and A is an anion which will form a salt with the ammonium cation.

Specific examples of such quaternary ammonium salts are dodecyl trimethyl ammonium chloride, hexadecyl trimethyl ammonium chloride, and octadecyl trimethyl ammonium chloride. Specific examples of anions, besides chloride, which will form salts with ammonium cation includes bromide, sulfate, etc.

The thickener component is used in amount of from about 1.0 percent by weight to about 25.0 percent by weight based upon the total weight of the functional fluid. The weight ratio of the associative polyether thickener to the quaternary ammonium salt in the thickener component is from about 1:10 to about 10:1, preferably from about 1:5 to about 5:1.

The functional fluids may also contain several optional ingredients, for instance, corrosion inhibitors, metal deactivators, and wear additives, which may be useful for specific applications.

Corrosion inhibitors which may be used include alkanolamines; other amines such as morpholine, N-methylmorpholine, ethylenediamine, and piperazine; nitrates; nitrites; phoshates; silicates; and benzoates.

Metal deactivators which may be used include triazoles and thiazoles.

Wear additives which may be used in the subject fluids include those described in U.S. Pat. No. 4,257,902, which is hereby incorporated into this application by reference.

This list of additional ingredients is not intended to preclude the use of other ingredients, but is merely designed to indicate that other optional ingredients may be used. Those skilled in the art will know what optional ingredients are likely to work and in what proportions for the specific problem to be solved.

The following examples will provide specific formulations and data regarding their thickening ability. The viscosities are in centistokes (cSt) and were measured at 100° F. by Cannon-Fenske capillary method unless otherwise indicated.

In the examples which follow, the following abbreviations will be used:

APT—an associative polyether thickener having an average molecular weight of approximately 17,000 prepared by reacting trimethylpropane with a mixture of ethylene oxide and propylene oxide (weight ratio of ethylene oxide to propylene oxide of approximately 85:15) to form a heteric intermediate, and then reacting the intermediate with approximately 4 to 5 weight percent of a mixture of $C_{15}$-$C_{18}$ alpha olefin epoxides.

DTC—dodecyl trimethyl ammonium chloride (50 percent active).

HTC—hexadecyl trimethyl ammonium chloride (50 percent active).

OTC—octadecyl trimethyl ammonium chloride (50 percent active).

QAS—quaternary ammonium salt.

COMPARISON EXAMPLE

A fluid containing 3 percent by weight of APT in water was prepared which had a viscosity of 12 cSt at 100° F. A fluid containing 4 percent by weight of APT in water was also prepared which had a viscosity of 70 cSt at 100° F. Three fluids containing 1 percent by weight of DTC, HTC, or OCT in water were also prepared, each of which had a viscosity of approximately 1 cts, which is approximately the viscosity of water.

EXAMPLES 1-3

In these examples, fluids were prepared containing 1 percent by weight of DT, HTC, or OTC; 3 percent by weight APT; and 96 percent by weight of water. The viscosity of the fluid containing DTC was 109 cSt; the viscosity of the fluid containing HTC was 237 cSt; and the viscosity of the fluid containing OTC was 439 cSt.

The results of the comparative experiments and Examples 1-3 can be summarized as follows:

| Fluid | Viscosity (cSt at 100° F.) |
|---|---|
| Water only | 1 |
| Water + DTC/HTC/or OCT | 1 |
| Water + 3% APT | 12 |
| Water + 4% APT | 70 |
| Water + 3% APT + 1% DTC/HTC/or OCT | 109-439 depending upon QAS used |

This summary illustrates the beneficial effect, in terms of viscosity, of using a thickener component containing an associative polyether thickener and a quaternary ammonium salt as defined by the subject invention.

The embodiments of the invention in which an exclusive privilege or property is claimed are defined as follows:

1. A functional fluid comprising (a) from about 60.0 percent by weight to about 99.0 percent by weight of water, a freezing point additive or both;

(b) from about 1.0 percent by weight to about 25.0 percent by weight of a thickener component comprising (i) an associative polyether thickener, and (ii) a quaternary ammonium salt having the following chemical structure:

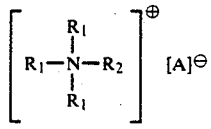

wherein $R_1$ is individually an alkyl radical having 1 to 4 carbon atoms, $R_2$ is an alkyl radical having 10 to 20 carbon atoms, and A is an anion which will form a salt with the ammonium cation;

such that the weight ratio of (i) to (ii) is from about 1:10 to about 10:1.

2. The fluid of claim 2 wherein the associative polyether thickener is an associative polyether thickener having a molecular weight of about 5000 to about 60,000 prepared by reacting ethylene oxide or ethylene oxide and at least one lower alkylene oxide with at least one active hydrogen-containing compound containing at least one active hydrogen and at least one long chain aliphatic alpha-olefin oxide or long chain aliphatic glycidyl ether each having a carbon chain length of about 12 to about 18 carbon atoms and wherein said alpha-olefin oxide or glycidyl ether is present in an amount of about 1 to about 20 percent by weight based upon the total weight of the thickener.

3. The fluid of claim 2 wherein the quaternary ammonium salt is selected from the group consisting of dodecyl trimethyl ammonium chloride, hexadecyl trimethyl ammonium chloride, octadecyl trimethyl ammonium chloride, and mixtures thereof.

4. The fluid of claim 3 wherein the ratio of (i) to (ii) is from 5:1 to 1:5.

5. The fluid of claim 4 wherein a wear additive and corrosion inhibitor are also components of the fluid.

6. The fluid of claim 5 wherein the associative polyether thickener is an associative thickener having an average molecular weight of 5000 to 40,000 and is prepared by reacting a mixture of ethylene oxide and propylene oxide in a weight ratio of 3:1 to 10:1 with trimethylol propane and then reacting with an alpha-olefin epoxide such that the weight percent of alpha-olefin oxide in the associative thickener is from 1 to 20 percent.

* * * * *